US012352515B2

(12) United States Patent
McMinn et al.

(10) Patent No.: US 12,352,515 B2
(45) Date of Patent: Jul. 8, 2025

(54) COMPACT ACTION WITH FORWARD CHARGING HANDLE INCORPORATED INTO AN UPPER RECEIVER HANDGUARD

(71) Applicant: 22 EVOLUTION LLC, Columbia, MO (US)

(72) Inventors: Seth Channing McMinn, Columbia, MO (US); John L. Overstreet, Fayette, MO (US)

(73) Assignee: 22 EVOLUTION LLC, Columbia, MO (US)

( * ) Notice: Subject to any disclaimer, the term of this patent is extended or adjusted under 35 U.S.C. 154(b) by 184 days.

(21) Appl. No.: 18/144,993

(22) Filed: May 9, 2023

(65) Prior Publication Data

US 2023/0272989 A1 Aug. 31, 2023

Related U.S. Application Data

(63) Continuation-in-part of application No. 17/537,770, filed on Nov. 30, 2021, now Pat. No. 11,668,538.

(51) Int. Cl.

| | |
|---|---|
| ***F41A 3/66*** | (2006.01) |
| ***F41A 3/26*** | (2006.01) |
| ***F41A 15/16*** | (2006.01) |

(52) U.S. Cl.

CPC ..... *F41A 3/66* (2013.01); *F41A 3/26* (2013.01); *F41A 15/16* (2013.01)

(58) Field of Classification Search

CPC ..... F41A 3/86; F41A 3/26; F41A 15/16

See application file for complete search history.

(56) References Cited

U.S. PATENT DOCUMENTS

| | | | | |
|---|---|---|---|---|
| 2,403,306 | A | 7/1946 | Sampson et al. | |
| 3,363,351 | A | 1/1968 | Smith | |
| 4,227,439 | A | 10/1980 | Gillum | |
| 4,358,986 | A * | 11/1982 | Giorgio | F41A 3/64 89/142 |
| 5,909,002 | A | 6/1999 | Atchisson | |
| 6,019,024 | A | 2/2000 | Robinson et al. | |
| 6,678,983 | B2 | 1/2004 | Jamison | |
| 6,931,978 | B1 | 8/2005 | Dionne | |
| 7,971,379 | B2 * | 7/2011 | Robinson | F41A 5/12 42/71.01 |

(Continued)

*Primary Examiner* — Reginald S Tillman, Jr.
(74) *Attorney, Agent, or Firm* — Dinsmore & Shohl LLP

(57) ABSTRACT

A compact action for a firearm including an upper receiver housing incorporating a barrel. A bolt and carrier are positioned within the receiver housing so that the bolt is engaged to a rear receiver end of the barrel in a cartridge chambering position. Guide rods are supported within the housing above the barrel and extend in parallel to a rear located end plate. The carrier includes a carrier key supported by and displaceable along the guide rods between the barrel and a rearward bumper component. A gas tube extends from a forward located gas block overlaying a gas discharge aperture in the barrel to a gas key for actuating the carrier rearwardly following discharge of a ballistic from the barrel. A fixed ejector is attached to the upper receiver, in combination with machining a slot into the carrier and the bolt, such that the ejector remains static such that, upon the bolt cycling, the spent shell casing contacts the ejector, causing it to be ejected out of the upper receiver.

17 Claims, 18 Drawing Sheets

(56) References Cited

U.S. PATENT DOCUMENTS

| | | | | |
|---|---|---|---|---|
| 8,448,363 | B2 * | 5/2013 | Fargnoli | F41A 35/06 42/16 |
| 9,291,415 | B1 | 3/2016 | Beaty | |
| 9,341,420 | B2 | 5/2016 | Foster | |
| 9,377,257 | B2 | 6/2016 | Foster | |
| 10,345,059 | B2 | 7/2019 | Gibbens et al. | |
| 10,345,074 | B1 | 7/2019 | Zamlinskiy | |
| 10,386,137 | B2 | 8/2019 | Steimke et al. | |
| 10,422,595 | B2 | 9/2019 | Law | |
| 10,598,451 | B1 | 3/2020 | Haidu | |
| 10,690,425 | B2 * | 6/2020 | Cassels | F41A 15/16 |
| 11,022,385 | B2 | 6/2021 | Steimke et al. | |
| 11,029,106 | B2 | 6/2021 | Law | |
| 11,112,199 | B2 | 9/2021 | Pizano | |
| 11,156,414 | B2 | 10/2021 | Law | |
| 11,466,944 | B1 * | 10/2022 | Serbu | F41A 3/26 |
| 2011/0277368 | A1 | 11/2011 | Overstreet et al. | |
| 2014/0076144 | A1 | 3/2014 | Gomez | |
| 2018/0010879 | A1 | 1/2018 | Bonine | |
| 2018/0022227 | A1 | 1/2018 | Foldesi | |
| 2020/0033079 | A1 | 1/2020 | Steimke et al. | |
| 2022/0049912 | A1 | 2/2022 | Law | |

* cited by examiner

COMPACT ACTION WITH FORWARD CHARGING HANDLE INCORPORATED INTO AN UPPER RECEIVER HANDGUARD

CROSS REFERENCE TO RELATED APPLICATIONS

The present application is a continuation in part of and claims priority from U.S. Ser. No. 17/537,770 filed Nov. 30, 2021.

FIELD OF THE INVENTION

The present invention relates generally to an action assembly for a firearm. More specifically, the present invention discloses a complete and compact action assembly incorporated into a firearm upper receiver and handguard, with an adapted receiver end plate attached to a lower receiver. The compact action assembly includes a forward positioned charging handle in combination with proprietary rear buffer retention components substituting for prior art buffer tubes associated with conventional AR type platforms.

Additional features include a fixed ejector provided in place of traditional spring loaded plunger style ejectors. The fixed ejector is attached to the upper receiver, in combination with machining a length extending channel into each of the carrier and the bolt. In this fashion, the bolted in ejector remains static such that, upon the bolt cycling, the spent shell casing contacts the ejector, causing it to be ejected out of the upper receiver.

BACKGROUND OF THE INVENTION

The prior art is documented with various types of firearm action assemblies, which as most broadly defined operate to facilitate the discharge of a chambered ballistic and subsequently to cycle a rearwardly traveling bolt and carrier resulting from the force of the discharge in a return forward directions and concurrent with chambering a subsequent ballistic fed from such as an attachable magazine.

AR style firearms operate under either of direct impingement or piston style configurations for assisting in gas operated reloading of a succeeding cartridge following discharge of a ballistic from an initially chambered cartridge. Direct impingement is a type of gas operation for a firearm that redirects or siphons from the barrel a portion of the gas from a fired cartridge into a gas block and then through a gas tube into the bolt carrier or slide assembly in order to actuate a carrier or gas key in order to rotate and unlock the bolt from the barrel cycle the overall bolt carrier group (also termed an action). In the instance of a gas piston, the pressurized gas resulting from the ballistic discharge is directed against a piston system incorporating a drive rod and prior to be discharged through a gas block.

Attempts have been made to substitute traditional AR direct impingement or piston style action assemblies with other designs in order to provide for cycling of the bolt and reloading of such as a magazine fed cartridge. A first example of this is disclosed in the weapon systems of U.S. Pat. No. 10,386,137 and US 2020/0033079, both to Steimke et al., which includes a receiver and an operating group including each of a bolt housed within the receiver and an operating rod assembly arranged to axially translate within the bolt. The operating assembly also includes each of a carrier assembly, bolt assembly and recoil assembly.

Additional examples from the prior art include Stussak U.S. Pat. No. 9,835,397, which teaches a firearm ejector movably coupled to a receiver disposed in a movement path of a breechblock and engaged by a cartridge casing during a recoil process to enable the cartridge casing to be ejected from the firearm.

Gangle, US 2022/0057156, teaches an ejector having two contact surfaces for making contact with a cartridge or case during the ejection phase of the firing cycle of the firearm. A first contact surface makes contact with the case head of a case, with a second contact surface or shelf serving to hold the case in place during the ejection phase of the firing cycle.

SUMMARY OF THE PRESENT INVENTION

The present invention discloses a compact action assembly incorporated into a firearm upper receiver, and including each of a receiver housing incorporating a barrel and a bolt and supporting carrier positioned within the receiver housing so that the bolt is engaged to a rear receiver end of the barrel in a forward most cartridge chambering position. A pair of guide rods are supported within the housing above the barrel and extend in parallel and spaced apart fashion from an intermediate location of the housing to a rear located end plate.

The carrier includes a carrier key supported by and displaceable along the guide rods between the receiver end of the barrel and a rearward bumper component positioned proximate the rear end plate. A gas tube extends from a forward located gas block overlaying a gas discharge aperture in the barrel, the gas tube extending to a gas key for actuating the carrier in a rearward direction following discharge of a ballistic from the barrel.

Also provided is a sideways extending charging handle secured to a forward location of the housing and which is manually displaceable along a lengthwise extending slot in the housing for actuating an interior slider, the slider including a rearward extending rail portion and in turn actuating the carrier key to cycle the carrier and bolt in a non-ballistic discharge condition.

The slider also traverses within an interior channel configured in the forward handguard housing portion and is configured to maintain clearance with the gas block and gas tube. A stopper component can be incorporated into the forward handguard portion for limiting forward motion of the slider.

The upper receiver housing includes a forward handguard portion and a rear attachable housing portion. The lengthwise extending slot in the housing further has a pair of first and second slots formed within opposite sides of the forward handguard portion, with an enlarged rear location of each slot permitting detachment of the charging handle upon removal of the carrier from the receiver housing.

Other features include a latch extending from the charging handle for facilitating angular rotation, a spring biasing the latch in a forward position. Also, a forward coil pin contacts a recess in a cross bar portion seated within the lengthwise extending slot. The rear located end plate further includes each of a retainer plate, a threaded plug engaging to an open rear end of the receiver housing and a picatinny style rail mounted plate.

A fixed ejector is attached to the upper receiver, in combination with machining a channel into each of the carrier and the bolt. In this fashion, the bolted in ejector remains static such that, upon the bolt cycling, the spent shell casing contacts the ejector, causing it to be ejected out of the upper receiver.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
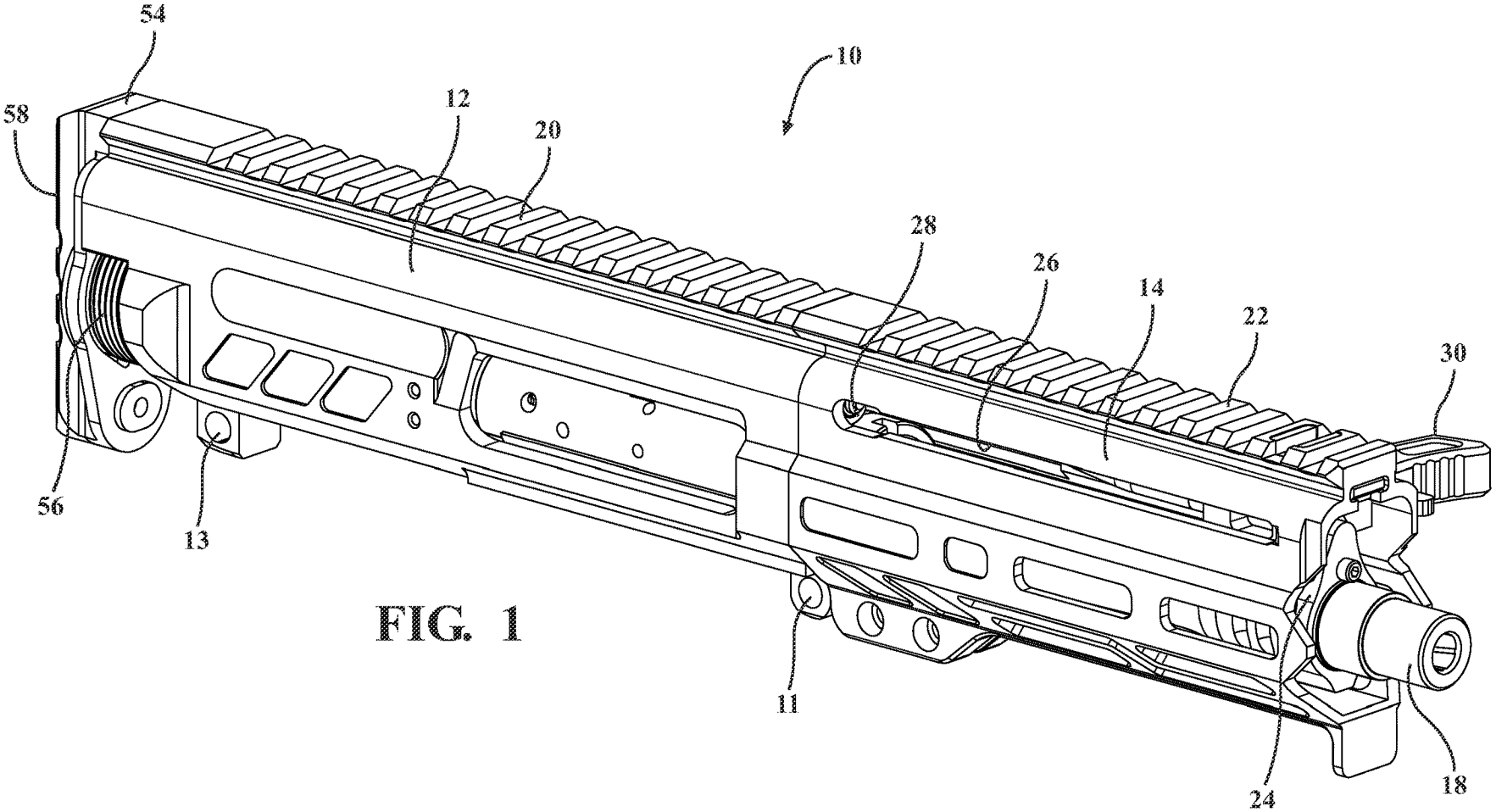
FIG. 1 is a perspective view of a firearm upper receiver incorporating the compact action according to the present invention.

With reference to the attached illustrations, the present invention discloses a compact action assembly incorporated into a firearm upper receiver and handguard, shown generally at 10 in each of FIGS. 1-4. As will be described in detail, the compact action assembly substitutes for conventional AR action assemblies which combine the bolt carrier group with a buffer tube and buffer spring arrangement and can be adapted for use with a variety of different calibers.

The upper receiver with compact action, as hereinafter described, is designed for use with a conventional lower AR type receiver (represented at 1) with an attachable pistol grip 2, via an attachable bolt or screw 3. The lower receiver 1 includes such known features as a trigger 4, hammer 5, fire selector 6 and disconnector spring 7. Other features include a bolt catch 8 and magazine release 9.

Figure 2:
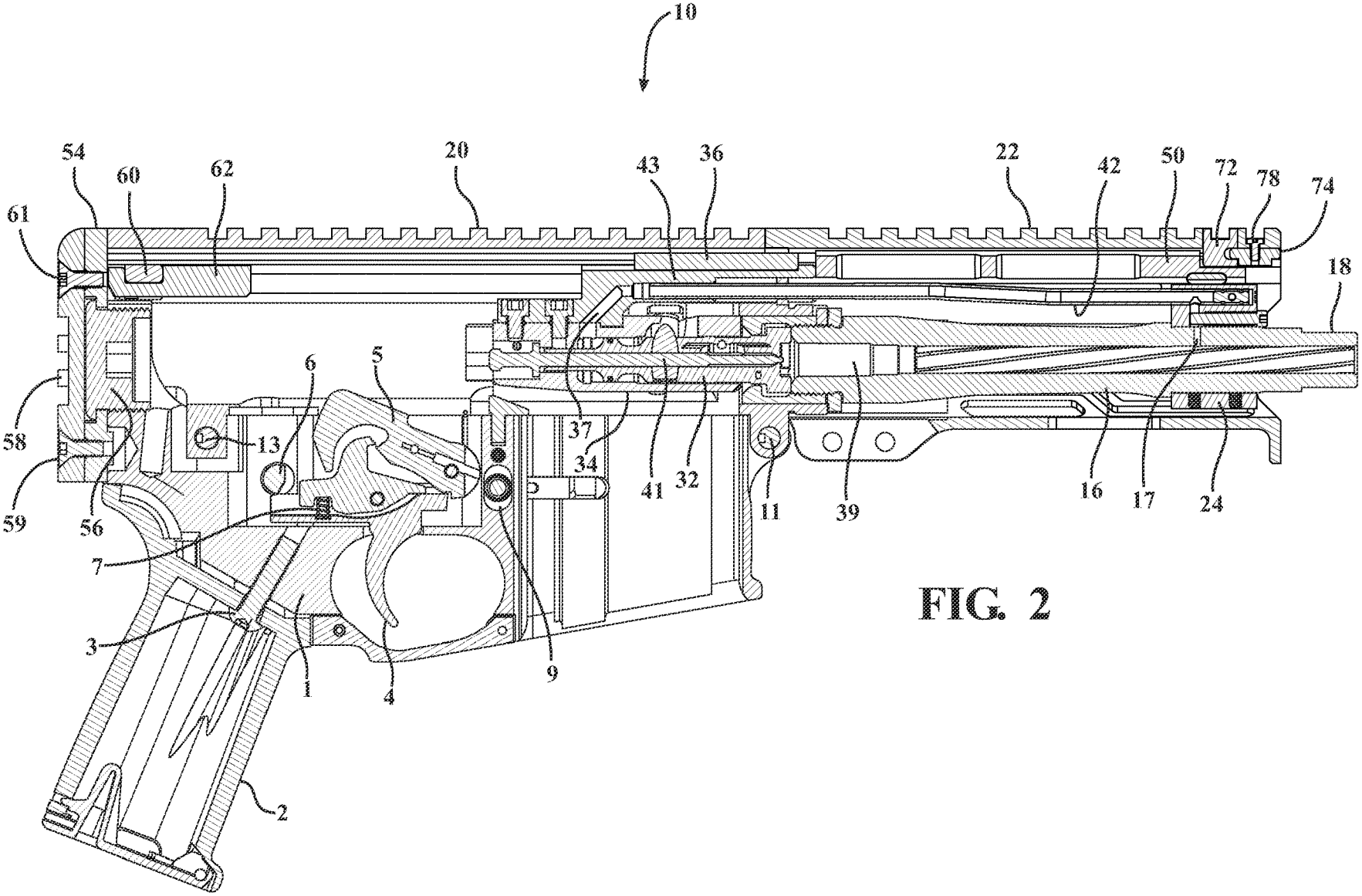
FIG. 2 is a plan cutaway view of FIG. 1 and illustrating the components of the compact action.
Figure 3:
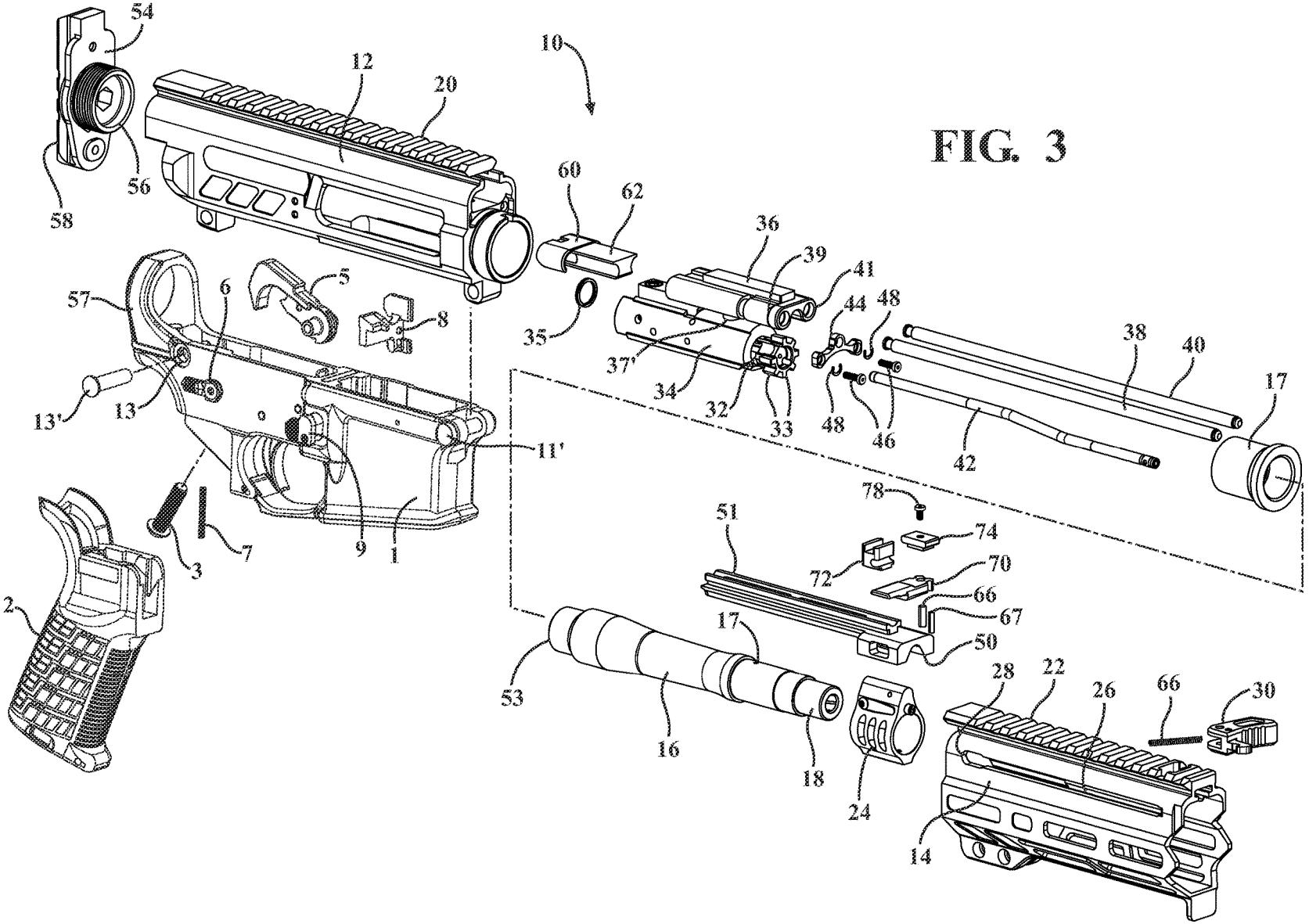
FIG. 3 is an exploded view of the upper receive with the various components of the compact action.

As best again shown in FIGS. 1-3 when viewed collectively, the upper receiving housing includes a rear portion 12, such including a forward pivot pin aperture 11 for receiving a forward pivot pin 11' and a rear takedown pin aperture 13 for receiving a rear takedown pin 13' and, separately, a forward attachable handguard portion 14. A barrel 16 (such as which is interiorly fluted as shown in the cutaway view of FIG. 2) is incorporated into the interior architecture of the upper receiver (as shown in FIG. 2 cutaway by assembling the forward 14 and rear 16 upper housing portions around the barrel 16).

A barrel extension 17 secures to a rear end (see as further shown at 53) of the barrel. As further shown, a forward muzzle end 18 of the barrel 16 projects a nominal distance forwardly of the handguard portion 14. Beyond that shown, it is further contemplated that the upper receiver 10 can be installed upon any suitable lower receiver, provided the adapted end plate (further described at 54 below) is incorporated into the lower receiver, and such as including without limitation to any standard AR type lower receiver incorporating a trigger group.

The housings further include such conventional features as a Picatinny style upper rail (see at 20 and 22 for housing portions 12 and 14). A forward located supporting collar portion and gas block 24 (see as best shown in FIG. 3) is proved for supporting the forward end of the barrel 16 and communicating a portion of the hot discharge gases being bled from the barrel (see aperture 17 in the barrel in FIG. 3).

Figure 9:
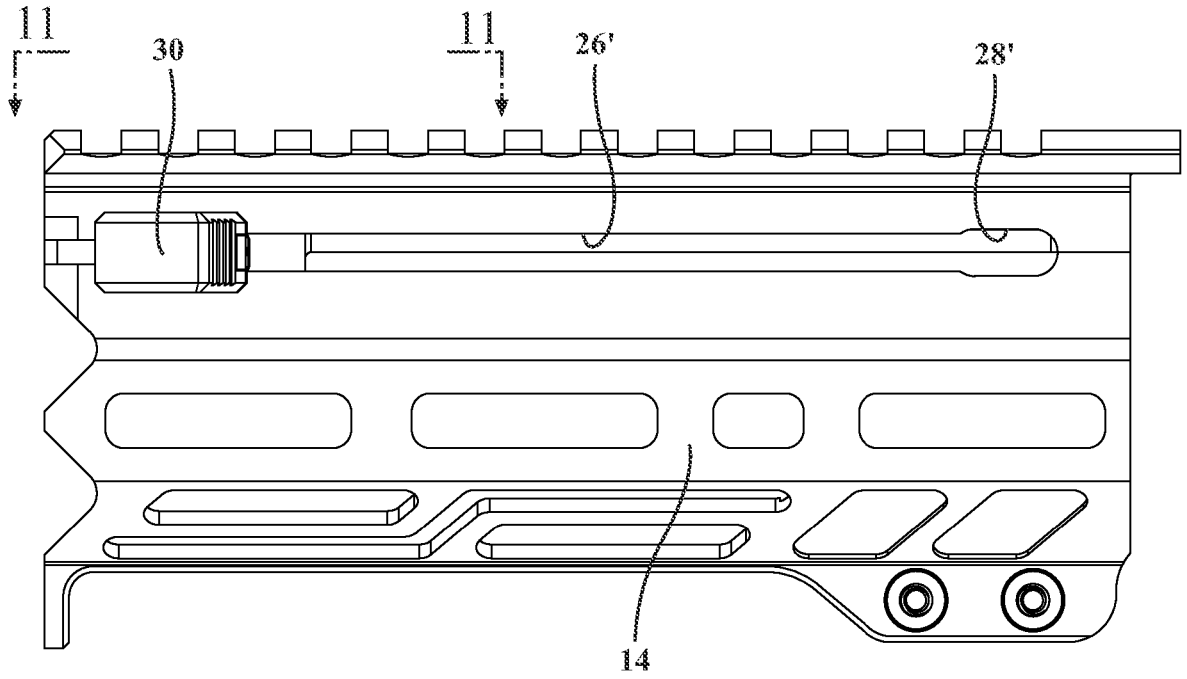
FIG. 9 is a plan view of a handguard portion of the upper receiver shown in FIGS. 1 and 3 and better illustrating the linear slot and forward charging handle.
Figure 12:
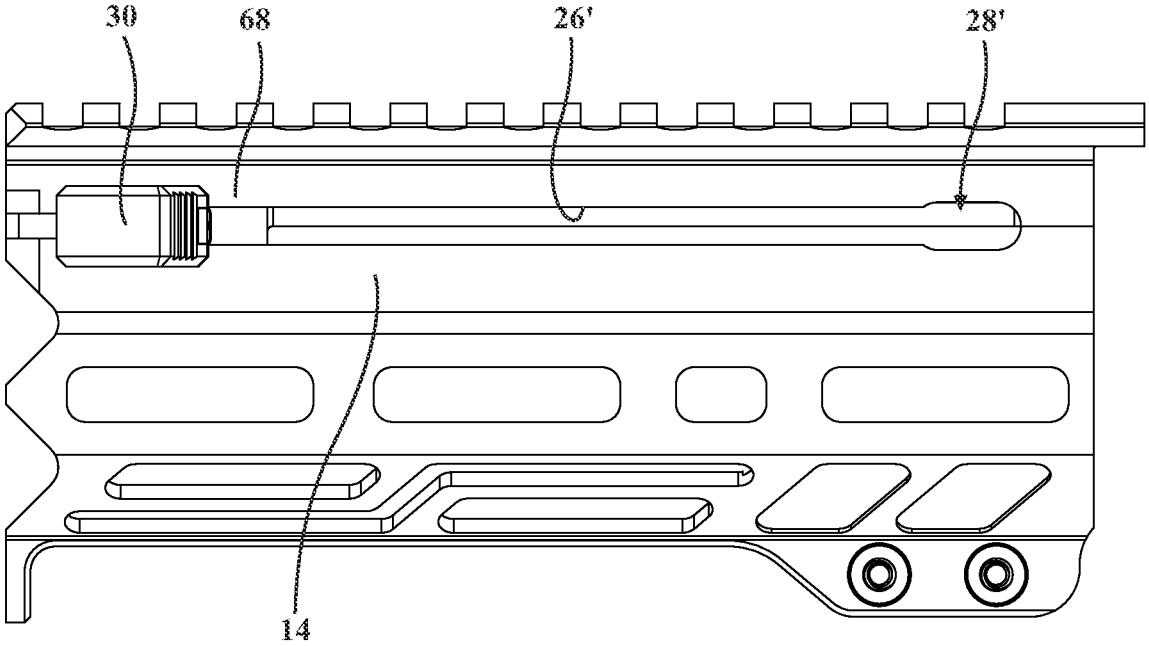
FIG. 12 is an illustration similar to FIG. 9 and depicting an enlargement in a rear most travel location of a slot for facilitating removal of the charging handle and latch.

The forward handguard portion 14 further includes mirroring slots (see at 26 in FIGS. 1 and 3 corresponding to a right handed use application) configured on a first side thereof of the forward handguard 14, and including an enlarged rear end location 28 for facilitating removal of a latch shaped charging handle 30 which is axially supported for displacement along the slot 26. FIGS. 9 and 12 further depicts a reverse second side of the handguard 14 with a mirrored axial slot 26' and enlarged rear location 28' to or from which the latch handle 30 can be reposition-ably mounted in a second left handed use application.

Figure 4:
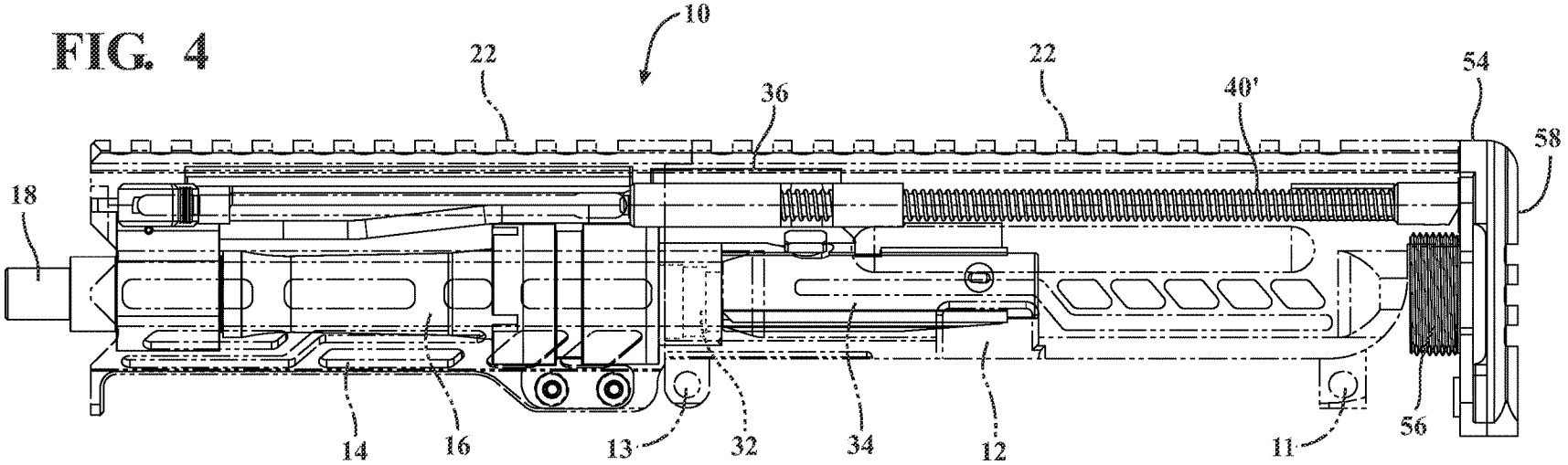
FIG. 4 is a one hundred and eighty degree rotated plan view of the upper receiver as depicted in FIG. 2 shown in partial phantom to better depict the components of the compact action.

Referring to FIG. 4, a one hundred and eighty degree rotated plan view is shown of the upper receiver as depicted in FIG. 2 in partial phantom to better depict the components of the compact action. In combination with the exploded view of FIG. 3, FIG. 5 provides a close up perspective of a bolt 32 with radial projecting forward lugs 33 and supporting bolt carrier 34, along with a carrier key 36 which rides upon a pair of guide rods 38/40 in a forward biasing direction.

Figure 15:
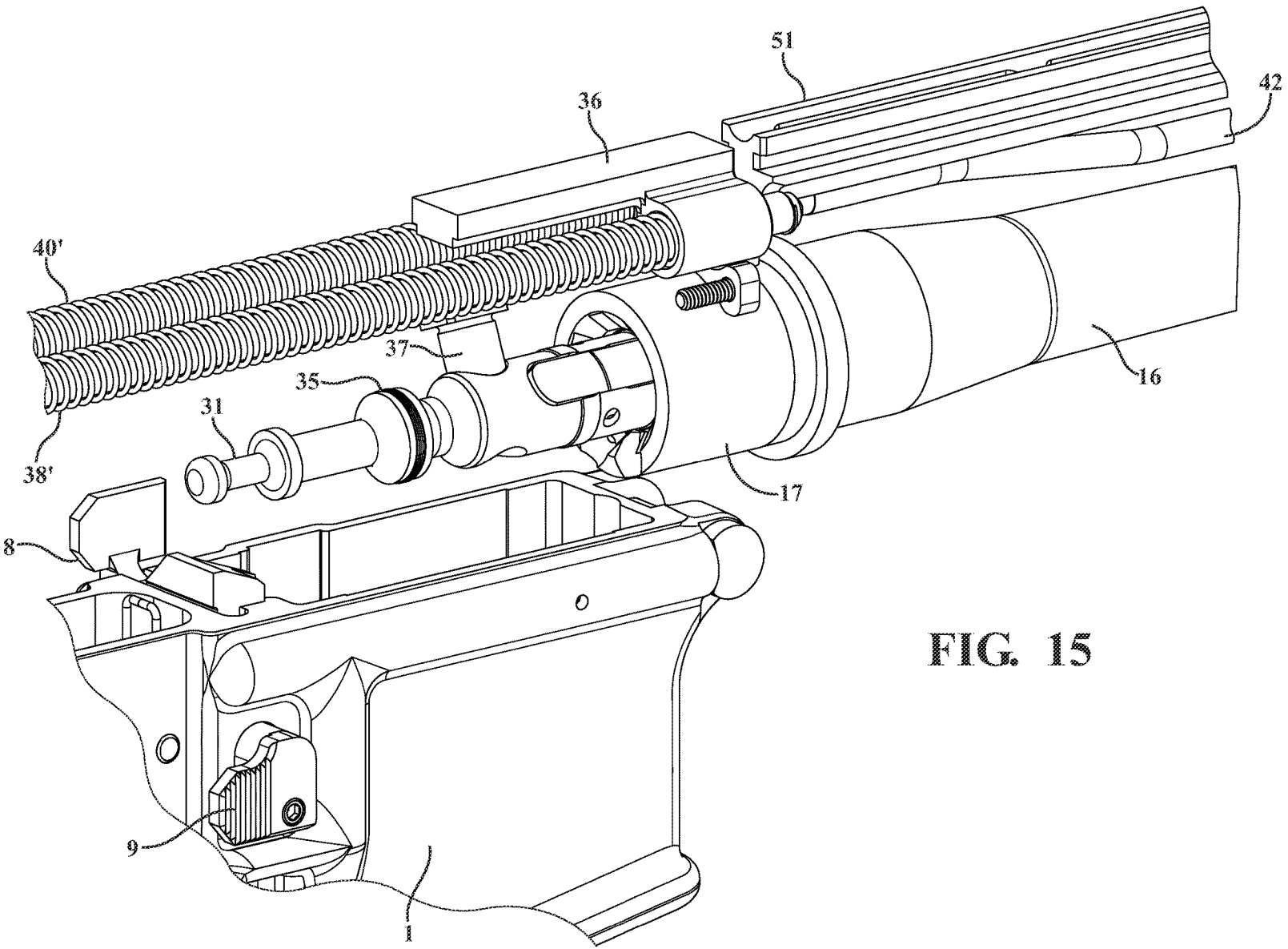
FIG. 15 presents an enlarged and partially cutaway perspective of the compact action with the rear portion of the upper receiver housing removed in order to better depict features of the bolt carrier group including each of the gas rings, cam pin and seating arrangement of the bolt lugs with the barrel receiver grooves.

As further shown in the partial cutaway perspective of FIG. 15 (in which the upper receiver portions 12 and 14 are removed) additional features associated with the bolt carrier group (or BCG) include each of firing pin 31, gas rings 35 (these being designed to trap the expansion of gas, allowing it to operate the bolt instead of just dispersing inside the upper receiver) and cam pin 37 (this further seating within an appropriately configured slot as partially represented at 37' in FIGS. 3 and 5) for rotating the forward lugs 33 to unseat from the inner barrel receiver grooves in order to rearwardly cycle the bolt 32.

The carrier key 36 further incorporates a pair of support locations 39/41 which receive the guide rods 38/40 in a parallel extending and spaced apart fashion between an intermediate location and a rear end plate location (see further referenced as previously referenced at 54).

Figure 5:
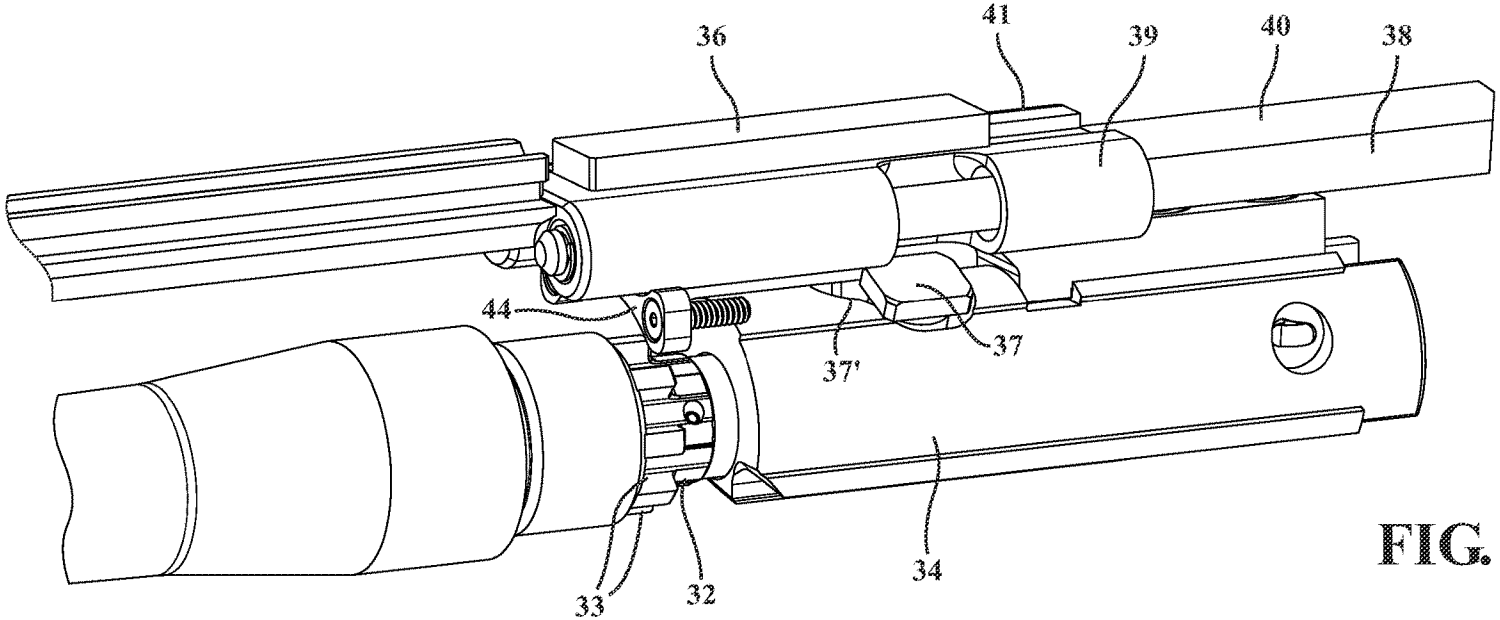
FIG. 5 is a close up perspective of the bolt carrier, carrier key and guide rods for supporting the carrier key in a forward biasing direction.
Figure 6:
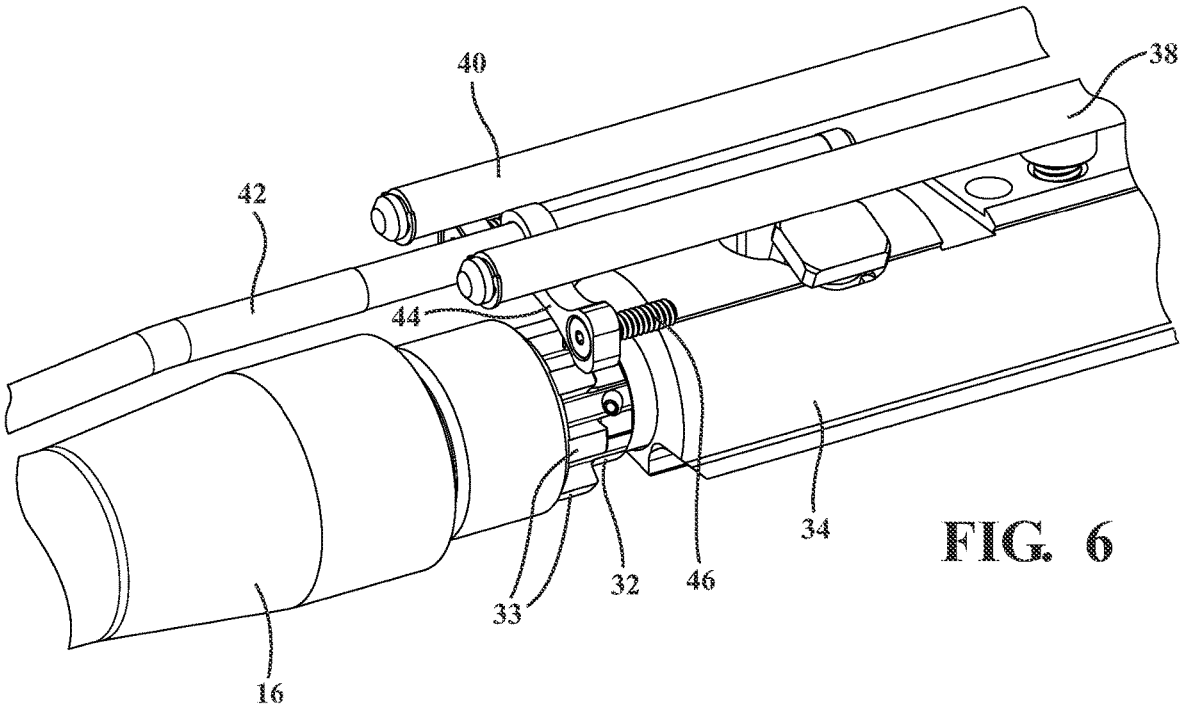
FIG. 6 is a further rotated perspective similar to FIG. 5 and illustrating the gas key located between the guide rods and which is positioned below the carrier key.

FIG. 6 is a further rotated perspective similar to FIG. 5 and illustrating a gas tube 42 which connects at the forward end to the collar shaped supporting gas block 24 in communication with the barrel 17 for feeding the pressurized gas rearwardly into contact with the carrier key 36 (see at location 37 in cutaway of FIG. 2) in order to initiate cycling of the action in response to detonation of the ballistic (not shown) once discharged from the supporting cartridge (see at 39 in FIG. 2 which is contacted by a forward end of a firing pin 41 supported within the bolt 32).

A gas key 43 (see again cutaway of FIG. 2) is located between the guide rods 38/40 and is positioned below the carrier key 36. The gas key includes an alignment component 44 (also a mounting portion) which is secured via a pair of screws 46 and washers 48 as shown in the exploded view of FIG. 3 for securing the gas tube 42 to the gas key 43 to a support location positioned between the carrier key 36 and main lower carrier 34.

A slider component 50 (see also FIG. 10) is incorporated into the front handguard 14. The interior slider component 50 includes a rearward extending rail portion 51 and rides within an interior channel 52 in the handguard (again FIG. 10), and is further configured to maintain clearance to the gas block 24 and gas tube 42. The rear of the slider 50 pushes against the front of the previously mentioned carrier key 36, which is attached to the carrier in standard AR15 fashion, such as with two bolts (not shown) inserted from the top down.

As further shown, the carrier 34 itself is shortened, as there is no buffer tube or spring. The carrier 34 and supporting carrier key 36 again rides along the two guide rods 38/40, with identical springs (as best shown at 38' and 40' in the partial cutaway view of FIG. 15) which seat over the guide rods 38/40 and rest against internal surfaces of the support portions 39/41 (see as further shown in FIG. 5 in which the springs 38'/40' are removed for clarity of illustration) located towards the front of the carrier key 36 in order to bias the bolt 32 and carrier 34 in a forward direction towards the rear collar shaped end 53 of the barrel 16 to which the barrel extension 17 is mounted in a non-limited variant. The carrier key 36 also rides above the gas tube alignment component, again at 44, that screws into the front of the carrier 34.

Figure 7:
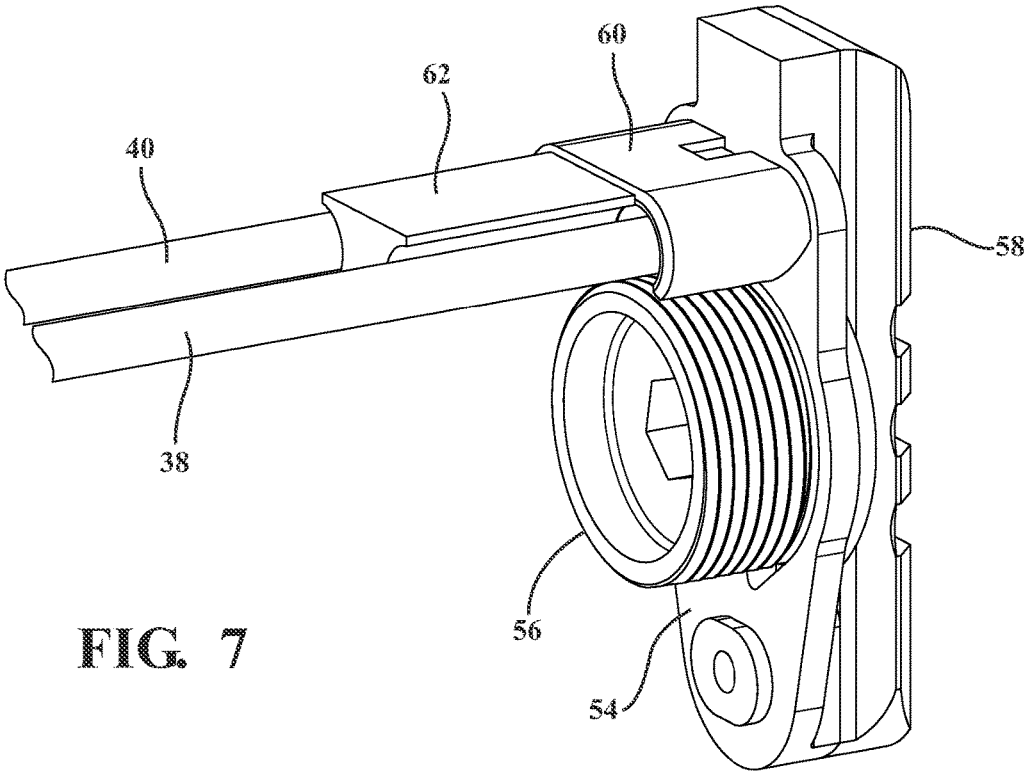
FIG. 7 is a perspective illustration of a rear end of the guide rods held by a retainer plate and which also provides a bumper component for interacting with the carrier key at a rearmost displaced location of the carrier prior to it contacting a rear threaded plug
Figure 8:
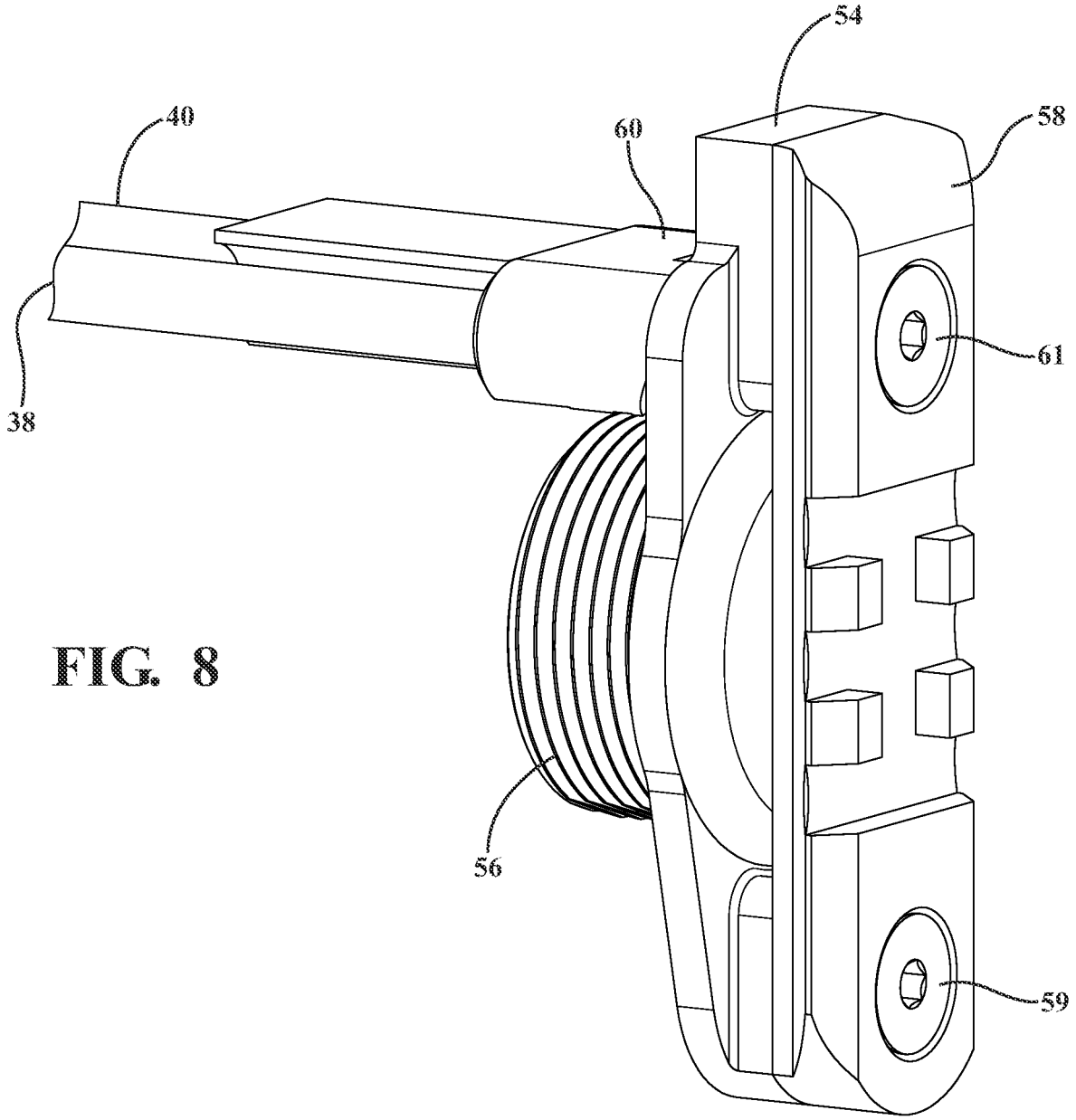
FIG. 8 is a further rotated perspective of FIG. 7 and depicting the rear buffer retention components including each of the retainer plate, plug and picatinny plate.

Proceeding to FIG. 7, a perspective illustration is shown of a rear end of the guide rods 38/40 held by the rear end plate 54 (also termed a retainer plate) incorporated into a rear buffer retention component for interacting with the carrier key 36 at a rearmost displaced location of the carrier 34 prior to it contacting a rear threaded plug 56 incorporated into the plate 54 and to which is engaged an open rear end of the rear receiver housing 12. FIG. 8 is a further rotated perspective of FIG. 7 and depicting the rear buffer retention components including each of the retainer plate 54, plug 56 and a rear exterior supported picatinny plate 58 which is mounted to the end plate by a pair of screws (see at 59 and 61 in each of FIGS. 2 and 8).

Figure 14:
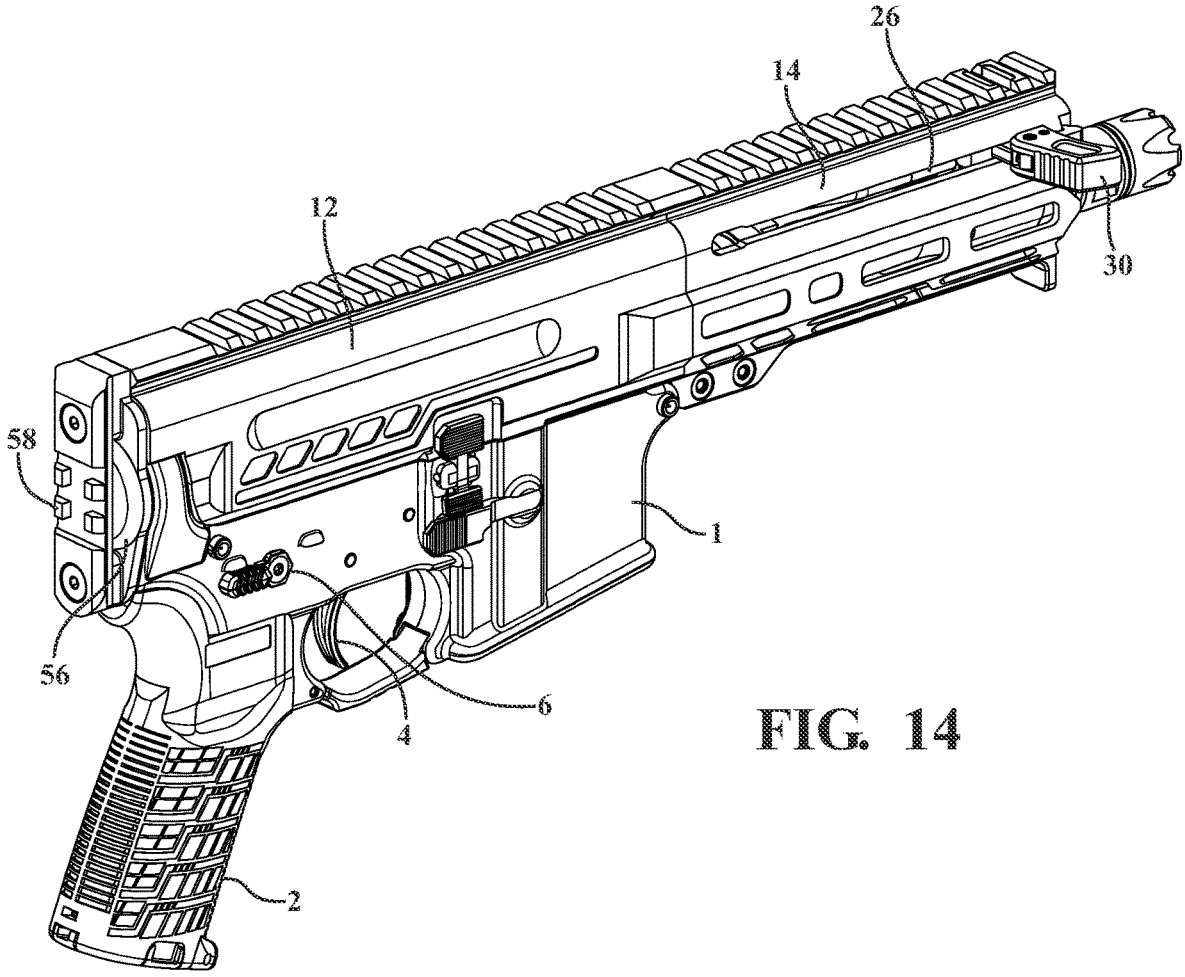
FIG. 14 is an assembled perspective of the compact action as substantially shown in FIGS. 2-3.

As additionally shown in each of the cutaway plan view of FIG. 2 and the perspective of FIG. 14, the end plate assembly is attached to the conventional lower receiver (see at 57 in FIG. 3) and instead of traditional buffer tube components as associated with prior art action assemblies. As again shown in FIG. 8, the rear side of the guide rods 38/40 is held by a retainer 60 secured to the end plate 54, which also locates a silicone bumper component 62 which acts as the end of rearward travel and interacts with the rearward displacing carrier key 36 prior to the carrier 34 hitting the threaded plug 56.

The three components (the retainer plate 54, threaded plug 56, and the picatinny plate 58), are mounted by the two screws 59/61. As previously mentioned, these components mate to an otherwise standard lower receiver as previously shown and described.

FIG. 9 is a plan view of the forward handguard portion 14 of the upper receiver (again shown in FIGS. 1 and 3) and better illustrates the linear slot (shown at 26') in combination with the forward charging handle 30. The present design allows the compact action firearm to be actuated with a forward charging handle. This requires a specific carrier key that is proprietary to this firearm, from which the rear of the slider 52 pushes off from.

Figure 10:
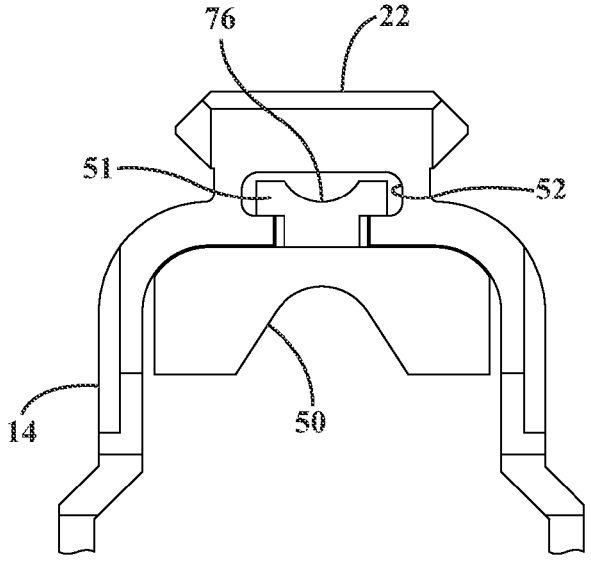
FIG. 10 is a rotated end plan view of FIG. 9 and illustrating the interior slider component which rides within an interior channel while maintaining clearance to the gas block and gas tube.
Figure 11:
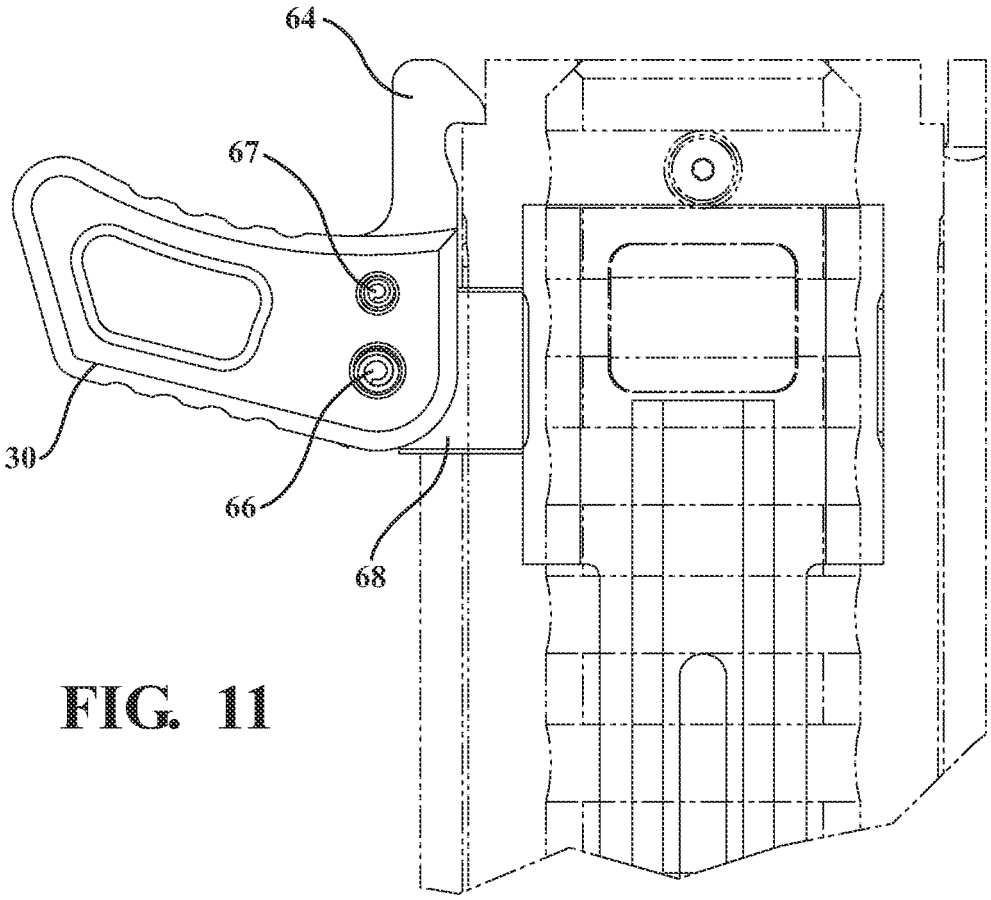
FIG. 11 is a downward looking view along area 11-11 of FIG. 9 and depicting the spring loaded and reversibly mounted charging handle installable within either side of the handguard and for actuating the slider.

FIG. 10 is a rotated end plan view of FIG. 9 and illustrating the interior slider component 50 which includes an upper projecting portion 51 which rides within the interior channel 52 while maintaining clearance for each of the gas block 24 and gas tube 42. FIG. 11 further depicts a downward looking view along area 11-11 of FIG. 9 and depicting the spring loaded and reversibly mounted charging handle 30 installable within either side of the handguard 14 for actuating the slider 50.

A latch 64 (see again as best shown in FIG. 11) allows for angular rotation, similar to existing standard AR15 charging handles, and retains the charging handle 30 in a forward position during firing with an internal spring 66 (see also as shown in FIG. 3 along with a second support pin 67). If a user pulls on the charging handle 30, it rotates, unlocking itself. The rotation is controlled by a forward coil pin 66, which hits against a recess defined in a crossbar portion 68. Also again shown is a second pin 67 located forward of the coil pin 66 for biasing the charging handle 30 in the forward direction.

The charging handle integrated latch 64 again is reversible, meaning that by removing the "Crossbar" piece and flipping it around, the handle 30 can be inserted from the right side of the firearm, vs the standard left side (for right handed shooters).

As previously described, The crossbar/latch 30 is retained in the handguard by the size of the slot 26/26', and can only be removed when the carrier 34 is removed from the upper receiver, allowing enough rearward travel of the latch 30 to reach the enlarged rear opening 28/28'. This is again depicted in the right handed application of FIGS. 1 and 3 and the opposing left handed application of FIGS. 9 and 12.

Figure 13:
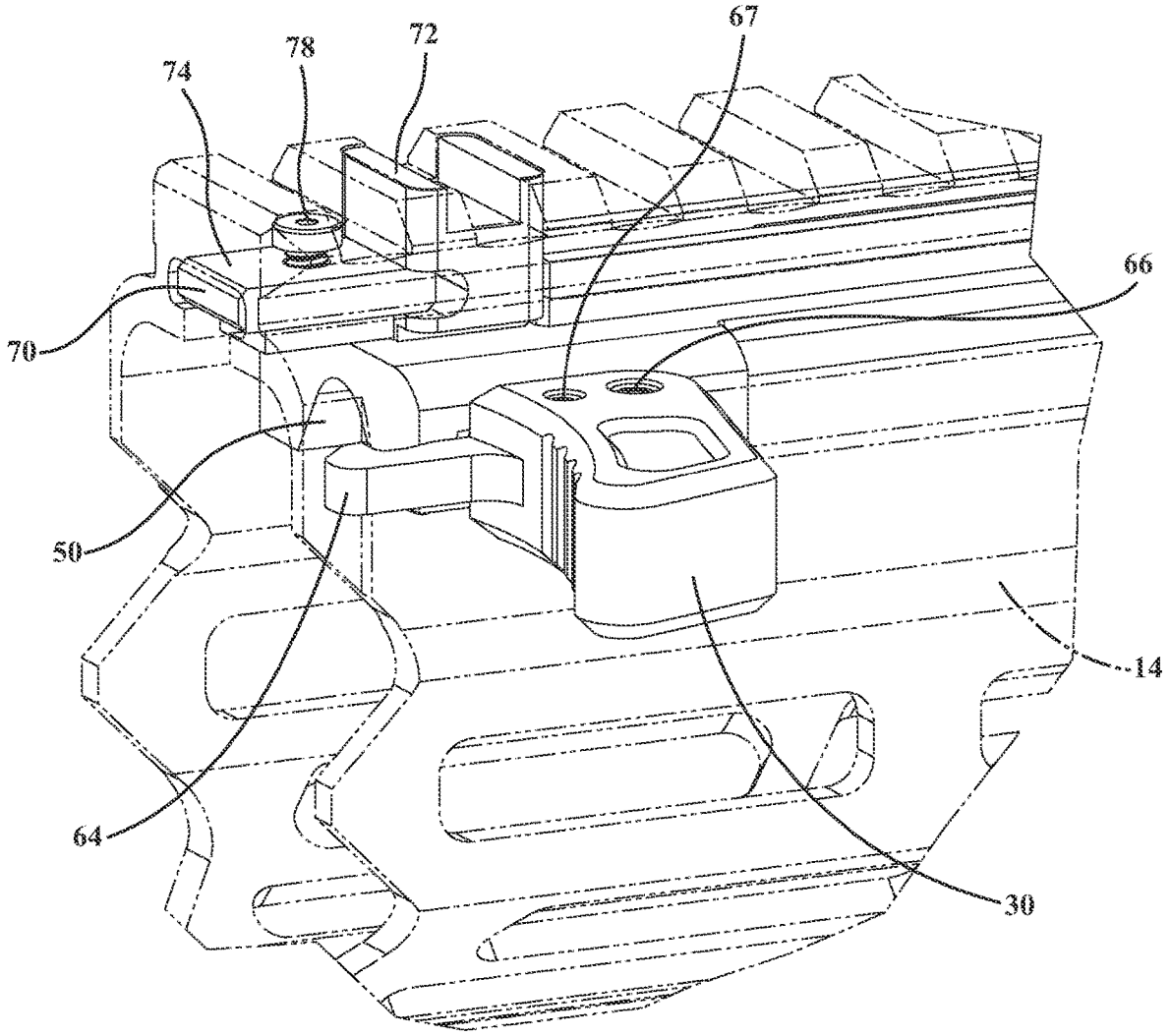
FIG. 13 is a rotated side perspective of the charging handle and interactive slider incorporated into the forward handguard and including an internal stopper component for limiting forward displacement of the slider.

FIG. 13 is a rotated side perspective of the charging handle 30 and interactive slider 50 incorporated into the forward located upper receiver handguard 14 and including an internal stopper component (see assemblable components 70, 72 and 74) for limiting forward displacement of the slider 50. Without limitation, the front of the slider is stopped by a steel "stopper" part (again at 72), which is retained by an aluminum threaded square washer (again at 74) that rides in a slider groove (see as best shown at 76 in FIG. 10). Screw 78 secures the washer 74 as shown.

Figure 16:
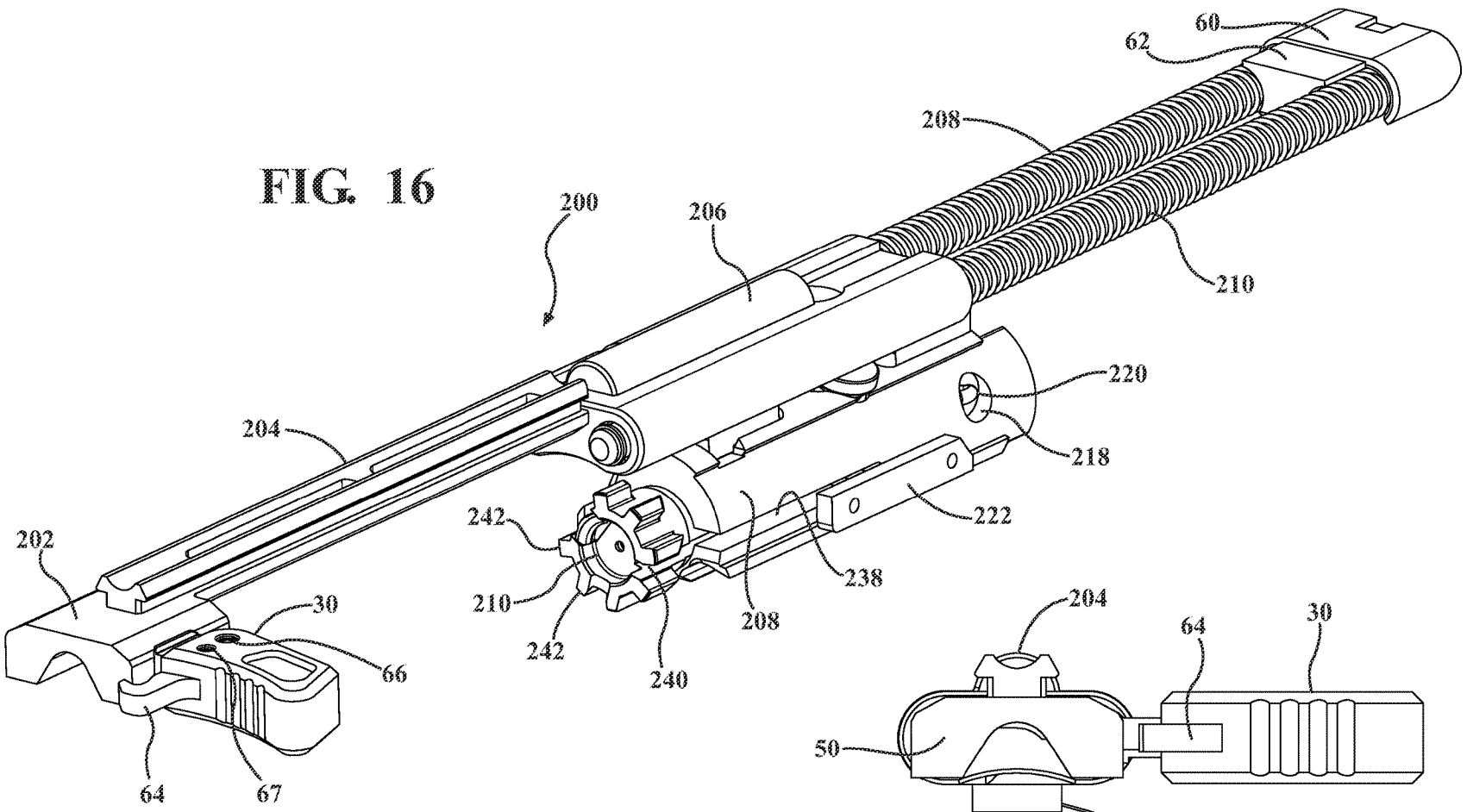
FIG. 16 is a perspective view of an action assembly, including charging handle and fixed ejector according to a further embodiment of the present invention.

Proceeding now to FIG. 16, a perspective view is generally depicted at 200 of an action assembly, including each of a charging handle 202 and supporting rail 204 and fixed ejector according to a further embodiment of the present invention. The action assembly 200 operates in similar fashion as that previously described in FIGS. 1-15 such that a repetitive description of identical features is unnecessary.

A redesigned carrier key 206 is depicted and which is displaceable along a similarly arranged pair of guide rods (hidden from view in FIG. 16 but depicting a similarly positioned pair of elongated coil springs 208 and 210 for biasing the carrier key 206 in a forward direction and such, that, upon ballistic discharge, the carrier key (along with supported bolt and carrier) displaces rearwardly in a direction toward the rearward located bumper component 62 and associated retainer 60.

As previously described, a slider component (see as shown at 50 in FIG. 10) is incorporated into the front handguard 14 and includes a rearward extending rail portion 204 which rides within an interior channel (previously at 52) in the handguard (again FIG. 10), to maintain clearance to the gas block 24 and gas tube 42. The rear of the slider again pushes against the front of the carrier key 206.

Figure 24:
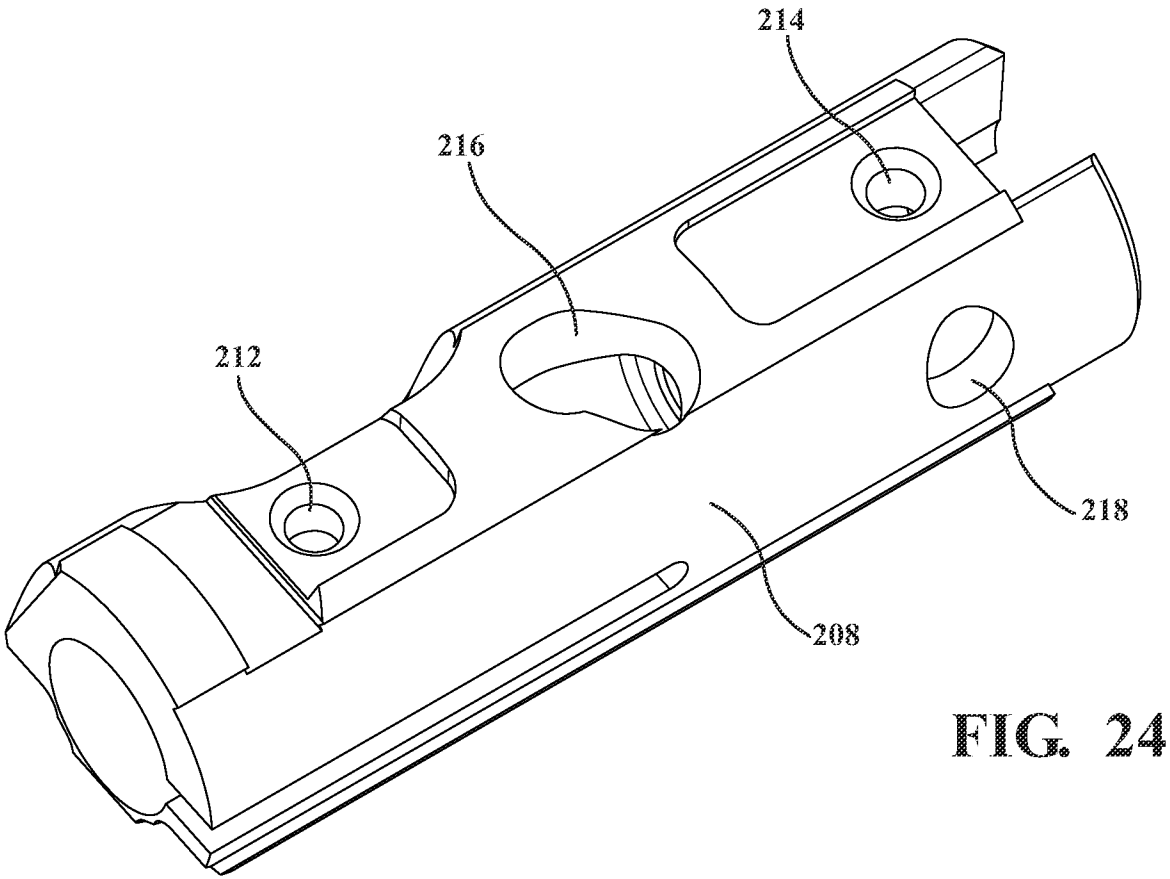
FIG. 24 is a perspective view of the carrier according to the second embodiment in order to better depict the manner in which the carrier key is attached.

Each of a redesigned carrier 208 and bolt 210 are provided and upon which the carrier key 206 is attached. As further shown in FIG. 24, a front 212 and rear 214 pair of screw receiving holes are formed in the carrier 208 on opposite (fore and aft) sides of a cam pin (at 217 in FIG. 22) for seating in projecting fashion from the receiving slot 216 (see also as shown at in FIG. 5) for attaching the carrier key 206 to the carrier 208. A further lateral aperture 218 in the carrier 208 is located for receiving the cotter pin 220 for securing in place the firing pin (not shown) contained within the bolt 210.

Figure 18:
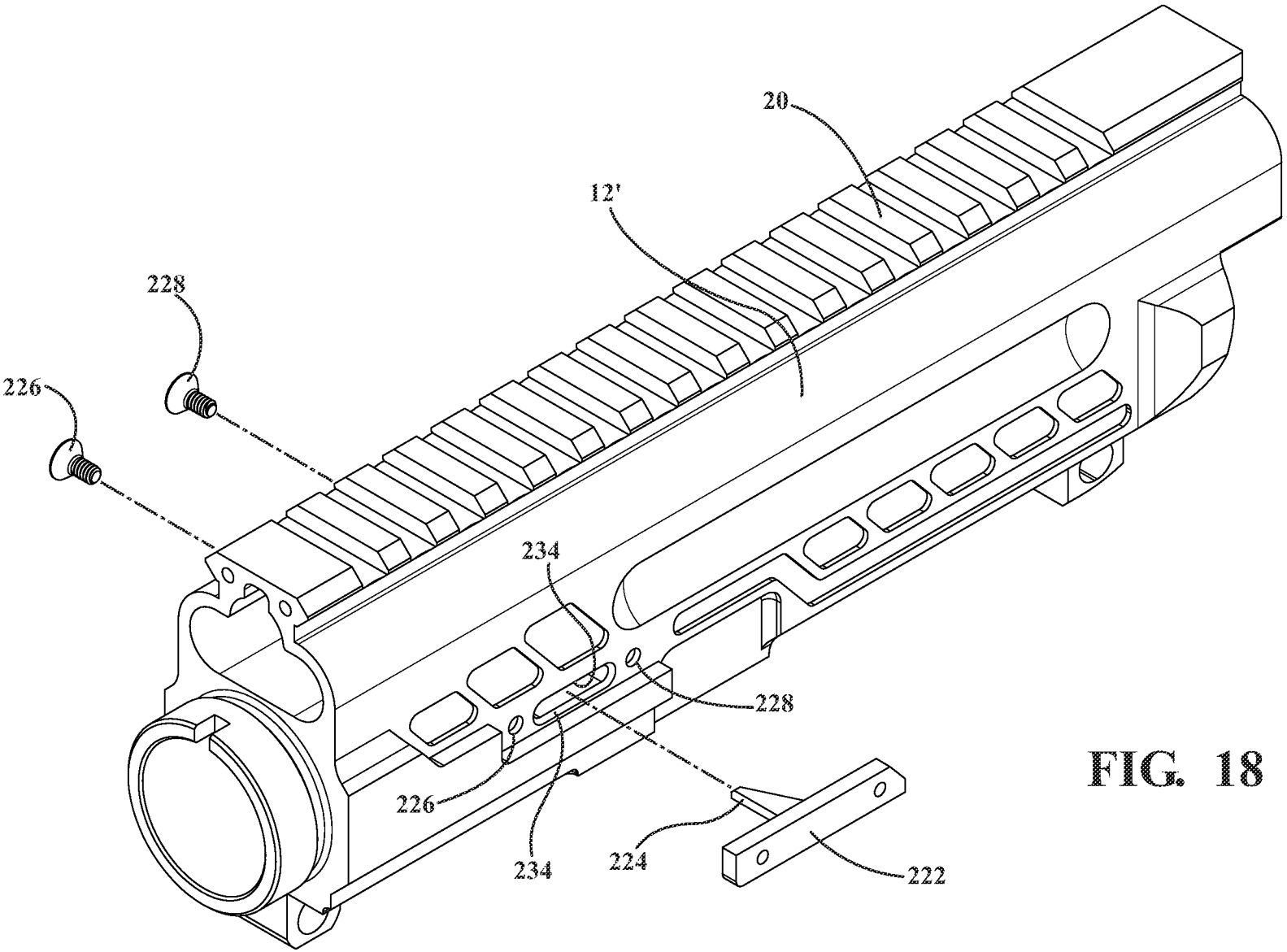
FIG. 18 is a perspective illustration of the manner of securing the fixed ejector to the upper receiver according to the embodiment of FIG. 16.

An ejector component is provided and includes a bar shaped portion 222 supporting an inward projecting portion 224 which, as best shown in FIG. 18 can include but is not limited to a modified triangular shape. Fasteners, such as a pair of bolts 226 and 228, secure through mounting apertures 230 and 232 (see FIG. 19) in the bar shaped portion 222 in order to secure the ejector bar against the exterior surface of the receiver housing 12' and further so that the projecting portion 224 is adapted to extend inwardly through an aperture 234 arranged within the upper receiver rear portion 12'.

Figure 19:
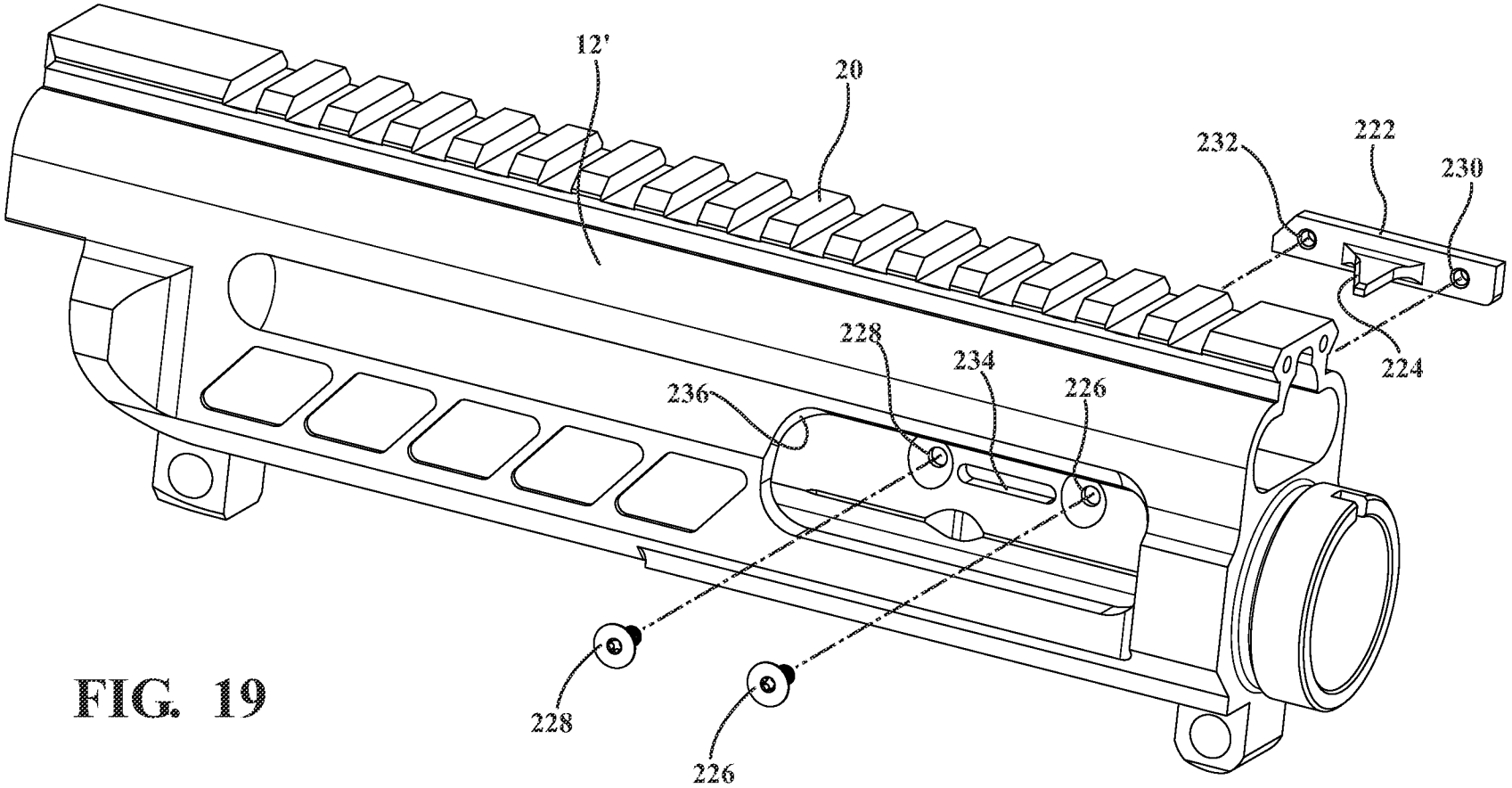
FIG. 19 is a rotated reverse side illustration of FIG. 18 and illustrating the anchoring of the fixed ejector from another direction.
Figure 20:
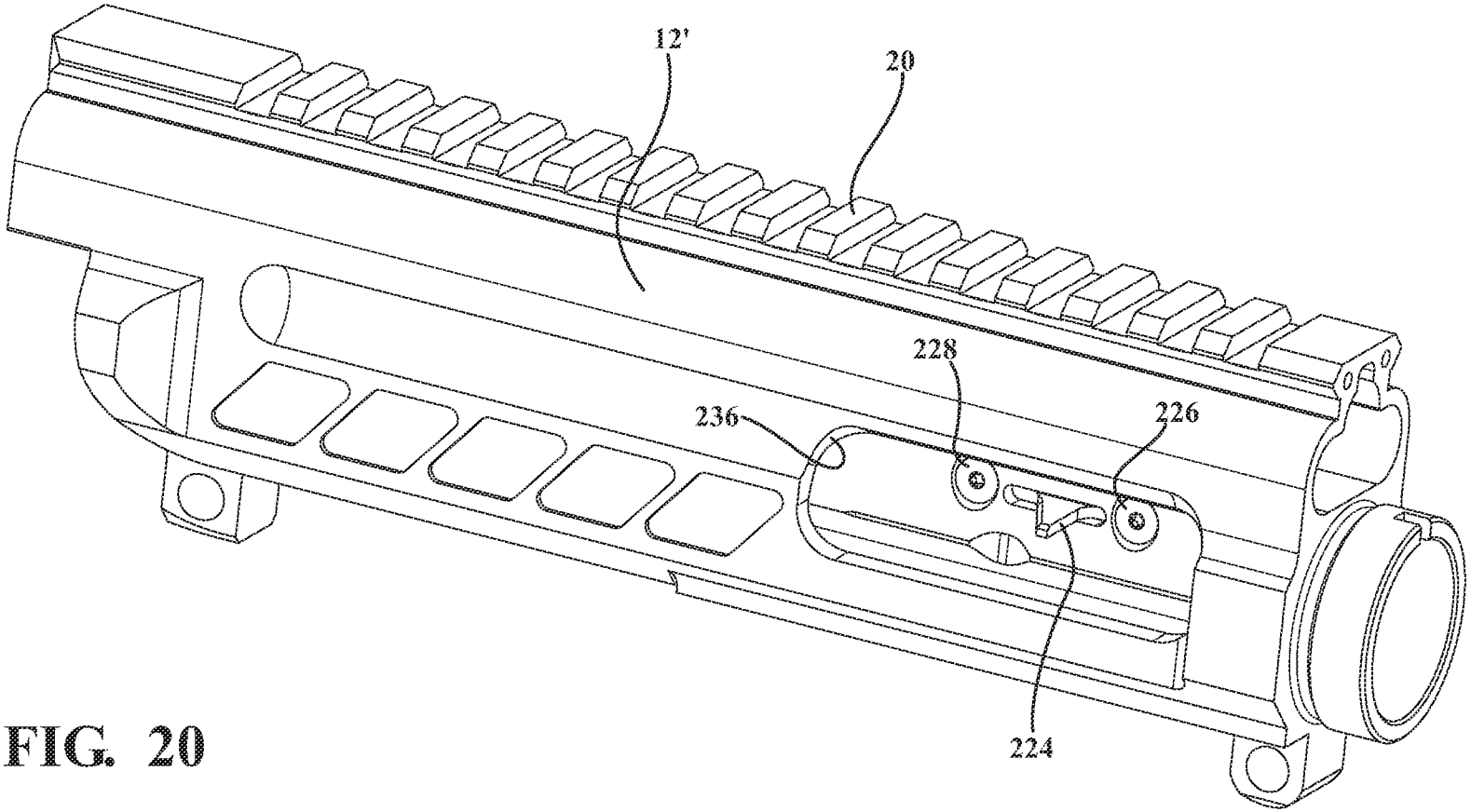
FIG. 20 is a succeeding view to FIG. 19 and depicting the assembly of the fixed ejector including its interior abutting orientation within the upper receiver interior.
Figure 21:
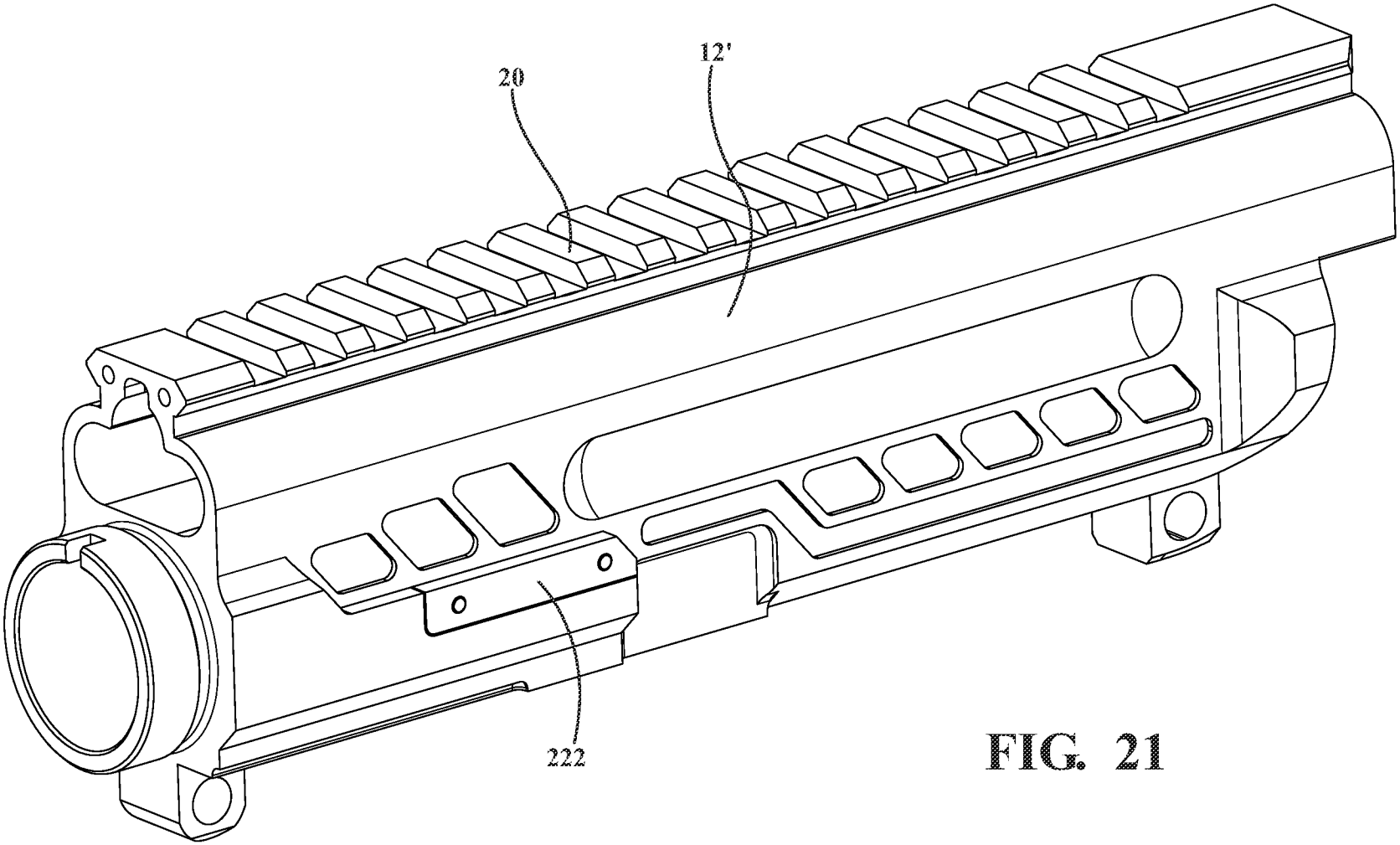
FIG. 21 is a succeeding assembly view of FIG. 18 showing the installation of the fixed ejector within the upper receiver from another direction.

This is best shown with reference to the succeeding views of FIGS. 19-20 in which an opening (see inner defined perimeter 236) in an opposite wall of the rear receiver housing 12'. FIG. 20 provides a succeeding view to FIG. 19 and depicting the assembly of the fixed ejector including its interior abutting orientation within the upper receiver interior, with FIG. 21 presenting a succeeding assembly view of FIG. 18 and showing the installation of the fixed ejector within the upper receiver rear housing 12' from another direction.

Figure 17:
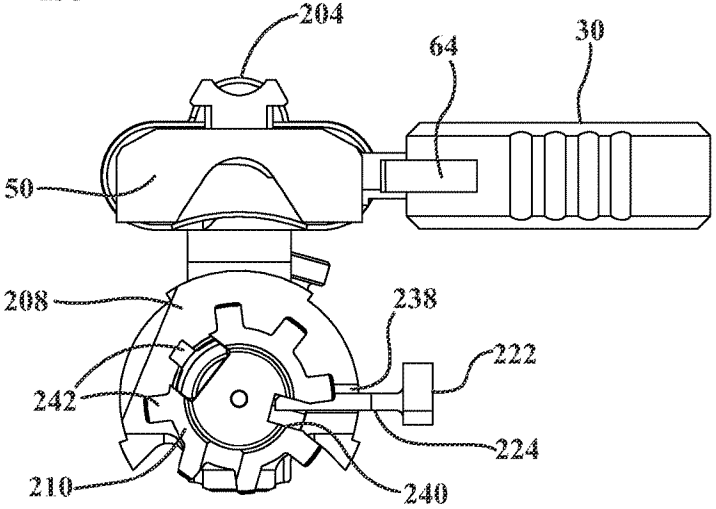
FIG. 17 is a front view of FIG. 16 and depicting the fixed ejector in position relative to the bolt and carrier in a fully forward engaged location of the bolt within the barrel receiver.
Figure 22:
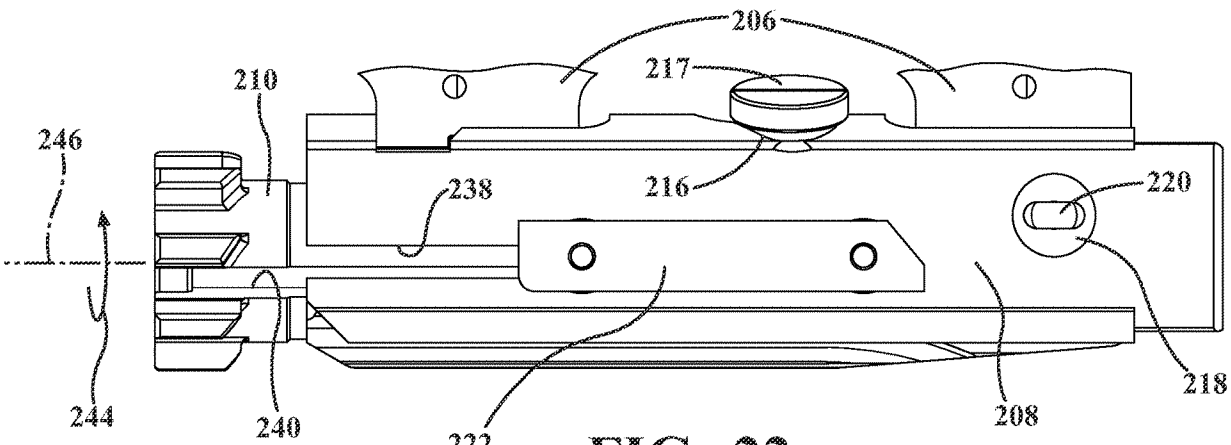
FIG. 22 is a side plan view showing the orientation of the fixed ejector relative to the partially offset channels formed in the carrier and bolt in the fully forward seated position to FIG. 17.
Figure 23:
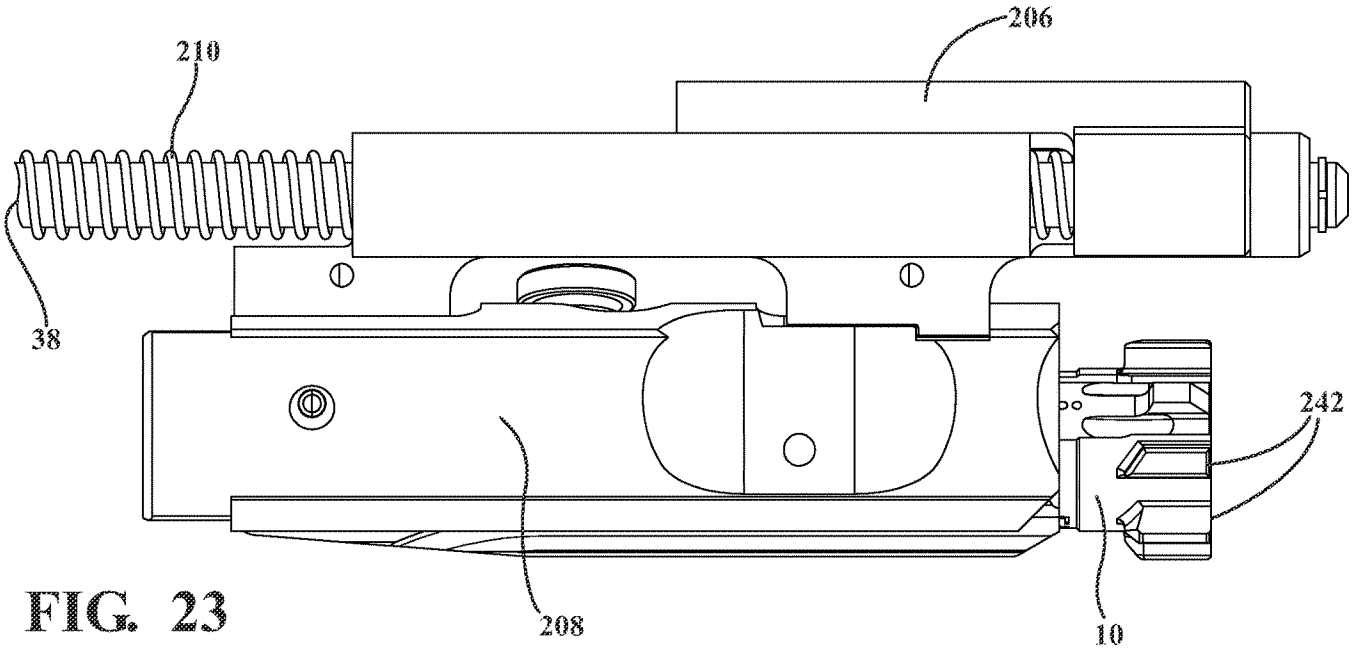
FIG. 23 is a rotated opposite side plan view depicting the attachment of the reconfigured carrier key to the carrier.

As best shown in each of FIGS. 16, 17 and 22, a first linear channel 238 is formed in the carrier 208 which seats the inward projecting portion 224 of the ejector. A second linear channel 240 formed in a head location of the bolt 210 extending rearwardly from its forward most located and circumferentially arrayed bolt lugs 242. As further shown, the second bolt channel 240 is partially offset from the first carrier channel 238, this when the bolt is in a forward most vertical or cartridge chambering position in which the bolt lugs 242 are seated within the opposing and offset receiving lugs (not shown) of barrel of the upper housing (see also shown in FIG. 5).

In this fashion, and simultaneous with the discharge of the ballistic, the bolt 210 is caused to incrementally rotate in a given direction, this depicted as a counter clockwise rotation as referenced by rotational directional arrow 244 in FIG. 22 taken relative to a linear centerline 246 through the bolt and carrier as shown in FIG. 22. Upon rotational unseating or unlocking of the bolt lugs 242 from the receiver end of the barrel (again shown at 16 with receiver end 53 in FIG. 3), the second bolt channel 240 is rotated into alignment with the first carrier channel 238, with subsequent rearward displacement of the bolt and carrier causing the spent shell casing (not shown) to contact the inward projecting portion 224 of the ejector and to be ejected out of the upper receiver housing 12' through the perimeter defined opening 236.

Upon reverse or return cycling of the bolt and carrier a new ballistic or cartridge is then loaded into the chamber and, upon the bolt head reaching a most forward seating position within the barrel receiver end, the lugs 242 are caused to rotate in a reverse direction to that previously shown at 244 in FIG. 22 in order to fully chamber the succeeding ballistic. Other features include the location of the channels 238 and 240 machined into the carrier 208 and bolt 210 avoids the cam pin 217 with the additional benefit of maintaining the durability of the components of the action assembly.

Without limitation, the fixed ejector configuration of the present invention can be adapted into other non-short action platforms, such including but not limited to any traditional AR 15 type platform utilizing a standard buffer spring and tube. This can further include adaptations thereof in which the bolt and carrier is modified in order to tune or vary a degree of recoil force exerted thereupon by the discharged ballistic, this in order to attenuate the recoil forces exerted by the firearm on the user.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The foregoing disclosure is further understood as not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosure. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense, and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application. Additionally, any signal hatches in the drawings/figures should be considered only as exemplary, and not limiting, unless otherwise specifically specified.

The invention claimed is:

1. A compact action assembly incorporated into a firearm upper receiver, comprising:

an upper receiver housing incorporating a barrel;

a bolt and supporting carrier having a carrier key positioned within said upper receiver housing so that said bolt is engaged to a rear receiver end of said barrel in a forward most cartridge chambering position;

said upper receiver housing including a forward portion and a rear portion;

a sideways extending charging handle projecting from a forward location of said upper receiver housing and which is displaceable along a lengthwise extending slot in said housing for manually cycling said carrier and bolt;

an ejector secured to said upper receiver housing;

a first channel formed in said carrier which seats an inward projecting portion of said ejector;

a second channel formed in said bolt which is offset from said first channel when said bolt is in said forward most cartridge chambering position;

a pair of guide rods extending in parallel and spaced apart fashion along an interior of said upper receiver housing to a rear located retainer, a pair of springs seating over said guide rods for biasing said bolt and carrier against said rear receiver end of said barrel;

said carrier key being supported by and displaceable along said guide rods between said rear receiver end of said barrel and a rearward located bumper component of said retainer;

a latch extending from said charging handle and engaged to said upper receiver housing such that, upon rotation of said latch about a spring biased pivot connection to said charging handle, said latch unlocks said charging handle from said housing, with subsequent displacement of said charging handle actuating a slider component supported within said housing, said slider component in turn contacting and actuating said carrier key during the manual cycling of said carrier and bolt; and simultaneous with discharge of the ballistic, said bolt rotating out of engagement with said receiver end of said barrel so that said second channel aligns with said first channel, with subsequent rearward displacement of the bolt and carrier causing the spent shell casing to contact said inward projecting portion of the ejector and be ejected out of the upper receiver.

2. The action assembly of claim 1, said lengthwise extending slot in said housing further comprising a pair of first and second slots formed within opposite sides of said forward portion, an enlarged rear location of each slot permitting detachment of said charging handle upon removal of said carrier from said receiver housing.

3. The action assembly of claim 1, said latch further comprising a forward coil pin offset from said spring biased pivot connection, said forward pin contacting a recess in a cross bar portion seated within said lengthwise extending slot for limiting rotation of said latch.

4. The action assembly of claim 1, the upper receiver attached to a lower receiver, further comprising an end plate secured to a rear of the lower receiver, said end plate mounted to the lower receiver by a threaded plug for engaging to an open rear end of the lower receiver and a rear exterior picatinny mounted plate.

5. The action assembly of claim 1, said slider component further comprising a rearward extending rail portion.

6. The action assembly of claim 1, said slider component traversing within an interior channel configured in a forward location of said receiver housing and being configured to maintain clearance with a gas tube extending from a forward located gas block overlaying a gas discharge aperture in said barrel, said gas tube extending to said carrier key for actuating said carrier and bolt in a rearward direction following discharge of a ballistic from said barrel.

7. The action assembly of claim 1, further comprising a stopper component incorporated into said forward portion for limiting forward motion of said slider component.

8. The action assembly of claim 1, said ejector further comprising a bar shaped portion supporting said inward projecting portion.

9. The action assembly of claim 8, further comprising fasteners securing said bar shaped portion to the upper receiver so that said projecting portion is adapted to extend inwardly through an aperture in the upper receiver.

10. The action assembly of claim 8, said inward projecting portion further comprising planar and modified triangular shape.

11. The action assembly of claim 1, further comprising a pair of front and rear located screw receiving holes formed in the carrier on opposite sides of a cam pin receiving slot for attaching said carrier key.

12. An action assembly incorporated into a firearm upper receiver, comprising:

a receiver housing incorporating a barrel;

a carrier key displaceable along a pair of guide rods within said receiver housing between a rear receiver end of said barrel and a rearward located retainer with bumper component supporting said guide rods;

a bolt and supporting carrier suspended underneath said carrier key positioned within said receiver housing so that said bolt is engaged to said rear receiver end of said barrel in a forward most cartridge chambering position;

said carrier securing to underside projecting portions of said carrier key via a pair of front and rear fastener receiving holes formed into said carrier on opposite sides of a cam pin seating in projecting fashion from a receiving slot and within a central open space defined between said carrier and carrier key;

an ejector secured to the upper receiver and having in inward projecting portion;

a first channel formed in said carrier within which is seated said inward projecting portion of said ejector;

a second channel formed in said bolt which is offset from said first channel when said bolt is in said forward most cartridge chambering position; and simultaneous with discharge of the ballistic, said bolt rotating out of engagement with said receiver end of said barrel so that said second channel aligns with said first channel, with subsequent rearward displacement of the bolt and carrier causing the spent shell casing to contact said inward projecting portion of the ejector and be ejected out of the upper receiver.

13. The action assembly of claim 12, said ejector further comprising a bar shaped portion supporting said inward projecting portion.

14. The action assembly of claim 13, further comprising fasteners securing said bar shaped portion to the upper receiver so that said projecting portion is adapted to extend inwardly through an aperture in the upper receiver.

15. The action assembly of claim 12, said inward projecting portion further comprising planar and modified triangular shape.

16. The action assembly of claim 12, further comprising a pair of front and rear located screw receiving holes formed in the carrier on opposite sides of a cam pin receiving slot for attaching said carrier key.

17. An action assembly incorporated into a firearm upper receiver, comprising:

a receiver housing incorporating a barrel;

a carrier key displaceable along a pair of guide rods within said receiver housing between a rear receiver end of said barrel and a rearward located retainer with bumper component supporting said guide rods;

a bolt and supporting carrier key positioned within said receiver housing so that said bolt is engaged to said rear receiver end of said barrel in a forward most cartridge chambering position;

said carrier securing to underside projecting portions of said carrier key via a pair of front and rear fastener receiving holes formed into said carrier on opposite sides of a cam pin seating in projecting fashion from a receiving slot and within a central open space defined between said carrier and carrier key;

a sideways extending charging handle projecting from a forward location of said housing and which is displaceable along a lengthwise extending slot in said housing for manually cycling said carrier and bolt;

an ejector secured to the upper receiver and having in inward projecting portion;

a first channel formed in said carrier, within which is seated said inward projecting portion of said ejector;

a second channel formed in said bolt which is offset from said first channel when said bolt is in said forward most cartridge chambering position;

said pair of guide rods extending in parallel and spaced apart fashion along an interior of said receiver housing to said rear located retainer, a pair of springs seating over said guide rods for biasing said bolt and carrier against said rear receiver end of said barrel;

and simultaneous with discharge of the ballistic, said bolt rotating out of engagement with said receiver end of said barrel so that said second channel aligns with said first channel, with subsequent rearward displacement of the bolt and carrier causing the spent shell casing to contact said inward projecting portion of the ejector and be ejected out of the upper receiver.

* * * * *